United States Patent [19]

Baum

[11] Patent Number: 4,584,052

[45] Date of Patent: Apr. 22, 1986

[54] VACUUM SINGLE FACER

[76] Inventor: Theodore M. Baum, 2 Indian Spring Rd., Byram, N.J. 07821

[21] Appl. No.: 401,885

[22] Filed: Jul. 26, 1982

[51] Int. Cl.[4] ..... B31F 1/28

[52] U.S. Cl. ..... 156/473; 156/497; 156/547; 156/578

[58] Field of Search ..... 239/597, 598, 589, 601; 118/315, 320; 156/471, 472, 473, 497, 308.4, 547, 578; 285/192

[56] References Cited

U.S. PATENT DOCUMENTS

| | | | |
|---|---|---|---|
| 2,068,155 | 1/1937 | Swift | 156/473 |
| 2,605,140 | 7/1952 | Bartling | 285/192 |
| 4,070,222 | 1/1978 | Olson | 156/497 |
| 4,251,313 | 2/1981 | Abe | 156/473 |
| 4,270,969 | 6/1981 | Kelley | 156/473 |
| 4,368,094 | 1/1983 | Mayer et al. | 156/473 |
| 4,381,212 | 4/1983 | Roberts | 156/473 |

*Primary Examiner*—Jerome Massie

*Attorney, Agent, or Firm*—Thomas J. Greer, Jr.

[57] ABSTRACT

A single facer machine of the vacuum or fingerless type for making a corrugated paperboard laminate. A new means for applying vacuum to the paperboard on the second corrugator roll. The second corrugator roll is provided with axially spaced circumferential grooves, the grooves being deeper than the flutes on the roll. Each groove is provided with a vacuum finger, coupled to a source of vacuum, each vacuum finger being curved at its intake mouth which sealingly engages the sides of its respective groove to supply vacuum thereto. The angular extent of the curved intake mouth is supplementary to the angular extent of engagement of the corrugated paperboard with the second corrugator roll.

4 Claims, 4 Drawing Figures

VACUUM SINGLE FACER

This invention relates to a vacuum single facer machine for making a corrugated paperboard laminate. The paperboard laminate is defined by two layers, the first being a corrugated web of paperboard to which is adhesively secured a second and flat paperboard web.

Typical machines for forming such a laminate include first and second corrugating rolls, each provided with flutes which mesh together, and a pressure roll. The pressure roll carries the second web for adhesive securement to the first or corrugated paperboard web. After the first web has been initially crimped or corrugated at the nip between the first and second corrugator rolls, one well known type of machine employs what are termed fingers to hold the corrugated web on the circumference of the second corrugating roll until the corrugated web leaves its roll to become adhesively attached to the flat or second paperboard web. The prior art is also aware of machines which employ vacuum instead of fingers for the purpose of holding the corrugated paperboard against the second corrugating roll. Vacuum fingerless facer machines are disclosed in the following U.S. Pat. Nos. Hahn—1,264,506, Smith—1,609,318, Swift—1,981,338, Langston—1,943,080, Palmer—2,055,877 Swift—2,068,155, Swift—2,018,240, Munters—2,429,482, Blair—2,480,316, Asakura—3,837,973, Deligt, et al—3,947,026, Wolnin, et al—3,972,763, Tokuno—4,177,102, Abe—4,241,969, and Kelley—4,270,969.

While at least partially successful in attempts to substitute vacuum for the usual hold-down fingers, the several arrangements heretofore evolved by workers in this art do not display the simplicity of construction inherent in the present invention. For example, the above-mentioned Abe patent for a fingerless machine discloses a vacuum chamber seal member which spans the flutes of the second corrugator roll. This results in a large amount of air pumped into the vacuum chamber, thus requiring a larger capacity power unit for the vacuum pumps. Further, the large volume of air also removes heat from the heated second corrugator roll. The above-noted Kelley patent requires a pair of auxiliary sealing grooves associated with each vacuum groove in the second corrugator roll.

Greater simplicity of construction and economy in operation are afforded by the practice of this invention. According to this invention, a plurality of axially spaced grooves are placed along the second corrugator roll of a single facer machine. Each groove receives a vacuum finger element. The mouth of the vacuum finger element is of the same shape, i.e., circular, as that part of the vacuum groove into which it fits. Its annular extent is supplementary to the annular extent of contact of the corrugated paperboard web with the second corrugator roll. That is to say, the sum of these two circumferential or angular extents is equal to a complete circle, i.e., 360°. Each vacuum finger is coupled to a vacuum supply tube, the tube in turn passing into and through the walls of a vacuum duct. The vacuum supply tube for each finger is provided with a lateral offset portion to accomodate tube movement caused by thermal expansion and contraction. The vacuum in the vacuum duct communicates with the interior of the vacuum tube by means of one or more slots in the vacuum tube. A quick disconnect coupling is provided between each vacuum finger and its associated vacuum tube, to thereby admit of ease and rapidity in disconnection for purposes of cleaning either the vacuum fingers or the slots associated therewith.

IN THE DRAWINGS

Figure 2:
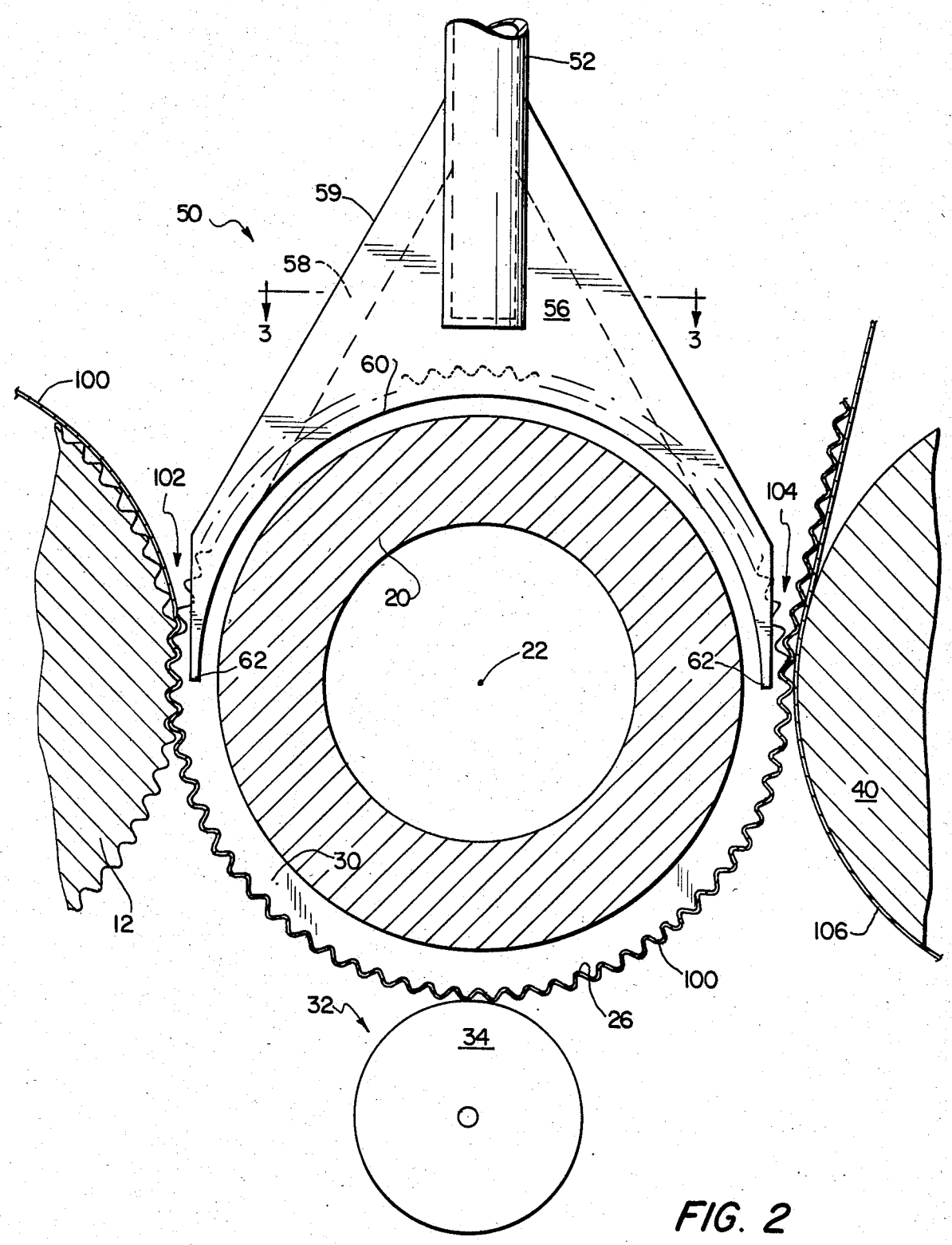
FIG. 2 is an enlarged section through a vacuum slot in the second corrugator roll and adjacent elements of FIG. 1.

Referring now to the drawings, the numeral 10 denotes generally the fingerless single facer machine of this invention. The machine includes a first corrugator roll 12 rotatable about its axis of rotation 14 and having the usual hollow interior 16 for the passage therethrough of a heating fluid such as steam. The periphery of the roll 12 is provided with flutes 18 which extend longitudinally along the roll surface. In practice, the roll may be approximately 87 inches in length, as is the length of the rolls later to be described. The numeral 20 denotes a second corrugator roll rotatable about its longitudinal axis 22, parallel with axis 14, and having the usual hollow interior 24 for the passage therethrough of a heating fluid such as steam. The numeral 26 denotes a plurality of flutes extending around the circumference of roll 20 and extending throughout the length of the roll. The numeral 30 denotes any one of a plurality of vacuum grooves of a depth, for example, of 13/16 inch and a width, for example, of about ⅛ inch. As shown at FIG. 2 for example, the slots 30 are annular. The depth is measured radially along the length of the roll. The numeral 32 denotes a conventional glue applicator including one or more rollers 34 which are immersed in an adhesive bath and which rotate and apply an adhesive to the tips of the corrugated web, as will presently be described. The numeral 40 denotes a pressure roll rotatable about its axis 42, the latter being parallel to the axis 14 and 22, and having the usual hollow interior 44 for the passage of a heating fluid such as steam. The surface 46 of the pressure roll is smooth.

Figure 3:
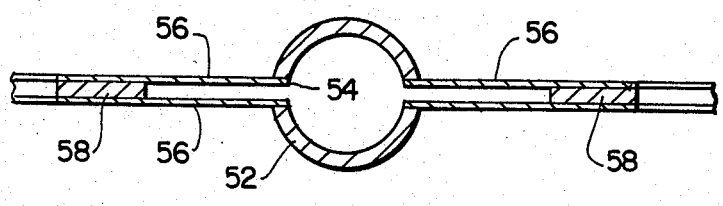
FIG. 3 is a view taken along line 3—3 of FIG. 2.
Figure 4:
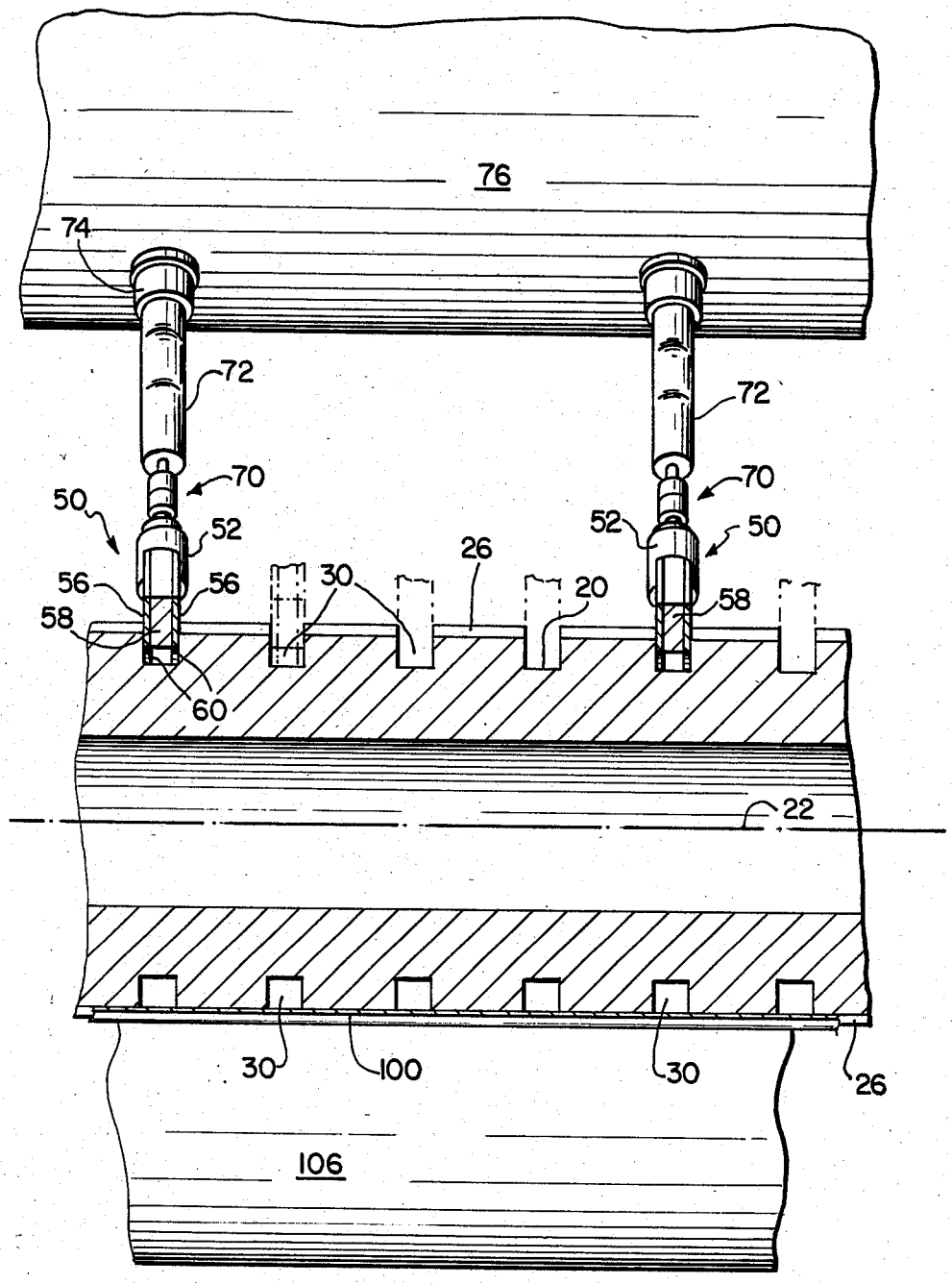
FIG. 4 is a partial cross-sectional elevational view taken along line 4—4 of FIG. 1.

The numeral 50 denotes generally any one of a plurality of vacuum fingers, each vacuum finger fitting into and being associated with each vacuum groove 30 of the second corrugator roll 20. FIGS. 2, 3 and 4 show further details of each vacuum finger 50. The finger includes a tubular element 52 having oppositely disposed slots 54. Sheet metal sections 56 are spaced as indicated at FIG. 3 by means of spacers 58. Typically, sheet metal elements 56 and spacer elements 58 may be fashioned from stainless steel or brass, these elements being welded or brazed together. Similarly, as indicated at FIG. 3, brazing may be employed to secure the upper portions of sections 56 to the tubular member 52. As indicated at FIG. 2, the sides 59 of the vacuum fingers 50 taper outwardly as they extend towards roll 20. The lowermost part of each vacuum finger, termed its mouth, is curved as indicated by the numeral 60. The two lowermost ends of each vacuum finger are denoted by the numeral 62, again as shown at FIG. 2. The reader will observe that curvature of each mouth 60 of each vacuum finger 50 is circular and that circular mouth 60 is radially spaced outwardly from the bottom of slot 30. As indicated by the dashed lines in FIG. 2, the depth or height of flutes 26 of the second corrugator roll 20, with the curved mouth portion 60 extending radially inwardly of the flutes 26.

Figure 1:
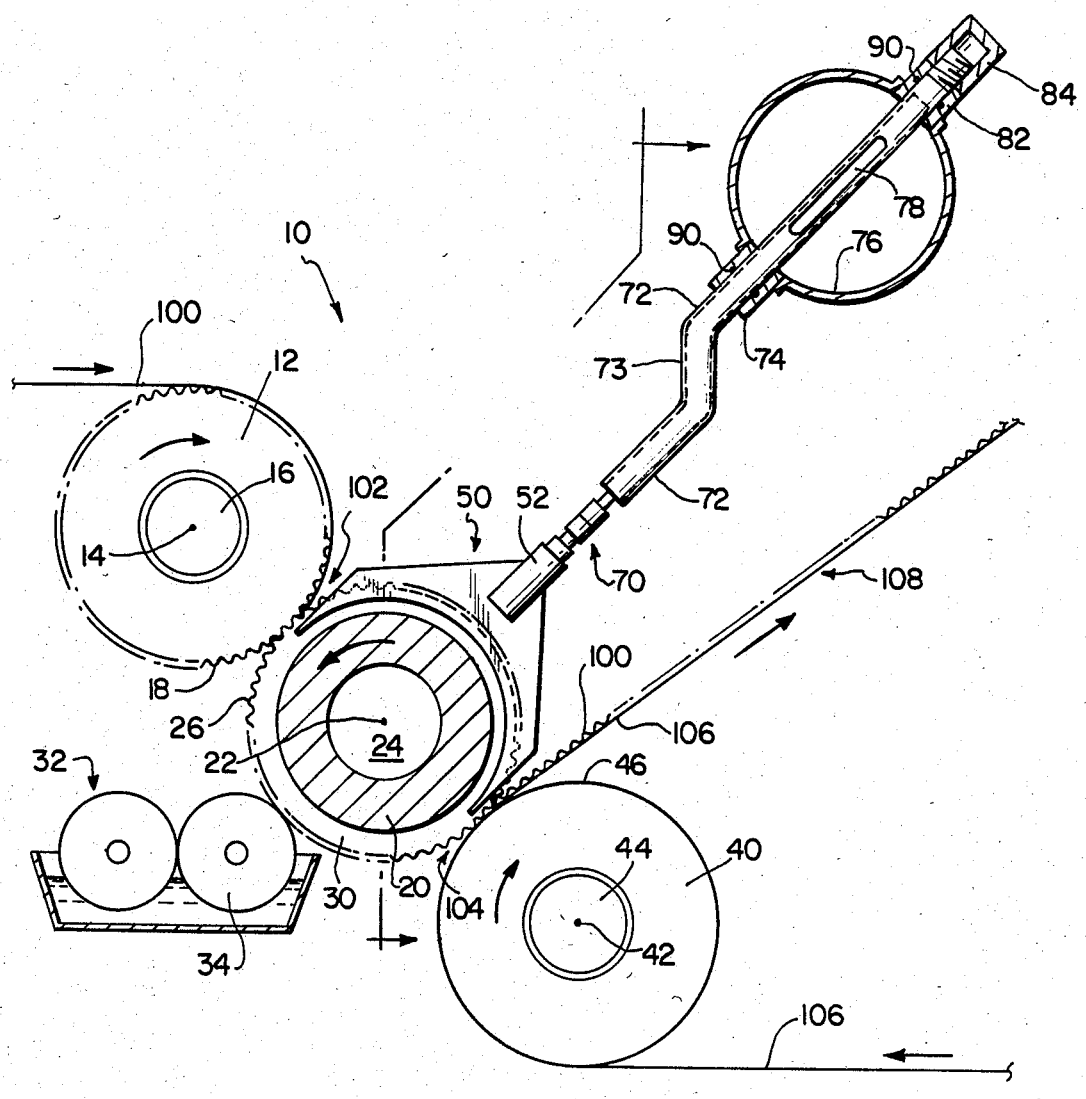
FIG. 1 is a partial schematic sectional view illustrating the single facer machine of this invention.

Referring now particularly to FIGS. 1 and 4, the numeral 70 denotes a quick disconnect coupling, of conventional construction, the coupling connecting tubular member 52 of vacuum finger 50 to vacuum supply tube 72. Tube 72 sealingly and slidably passes through a seal sleeve 74 and into the interior of a common vacuum supply duct 76. One or more slots 78 are provided in the wall of vacuum tube 72, so that these slots are in communication with the interior of vacuum duct 76. The uppermost end of vacuum supply tube 72 sealingly and slidably passes through another seal sleeve, denoted by the numeral 82, also carried by vacuum duct 76, with the end of vacuum tube 72 being threadedly connected to rotatably adjustable cap member 84. By rotating cap member 84, vacuum supply tube 72 is movable along its longitudinal axis, to thereby adjust or position the vacuum finger 50 associates with it, with respect to corresponding vacuum groove 30. Sleeves 74 and 82 are provided with O-rings 90 to facilitate sealing with tube 72. Offset portion 73, typically about four inches, is provided along tube 72.

While FIG. 4 shows only four vacuum grooves 30 in roll 20, in practice vacuum grooves 30, each provided with its own vacuum finger 50 and associates tube 72 connected to vacuum duct 76, are spaced approximately three inches apart along second corrugator roll 20. The endmost vacuum fingers are each spaced approximately three inches from its respective end of the second corrugator roll.

Referring again to FIG. 1 of the drawings, the operation of the machine is as follows. A first paperboard web, originally flat, denoted by the numeral 100, passes over the first corrugating roll 12 and thence into the nip 102 between the first and second corrugator rolls. The intermeshing of the flutes 18 and 26 causes the first paperboard web to conform to the flutes 26, the web thus becoming crinkled or corrugated. The web 100 then passes around the circumference or exterior of second corrugator roll 20 where its outside peaks or tips are contacted by glue or adhesive applicator 34. Continuing the motion, the now adhesively coated and crinkled web 100 passes to nip 104 between rolls 20 and 40 where its peaks or tips are adhered to second, flat paperboard web 106 by the action of pressure roll 40 urging these two paperboard web members together. The result is a two element laminate 108 having one layer defined by paperboard web 16 (still flat) and the other layer defined by corrugated paperboard web 100, these elements being joined to form the laminate by virtue of the adhesive applied by applicator 32.

During the above-described operation, any conventional vacuum source or pump (not illustrated) is attached to vacuum duct 76. The vacuum communicates by virtue of slots 78, vacuum supply tubes 72, coupling 70 and vacuum finger 50 to each vacuum groove 30. Referring now to FIG. 2, the angular extent of curved mouth 60 of each vacuum finger 60 is seen to be 180°. Further, the angular extent of contact between first paperboard web 100 with second corrugator roll 20 is seen to be 180°. These two angular extents are thus supplementary, i.e., their sum is a complete circle. Over the 180° of contact of paperboard web 100 with corrugator roll 20, the reader will now easily visualize that atmospheric pressure is pushing on the outside of paperboard web 100, radially inwardly, urging and maintaining the corrugations of web 100 in close and conforming contact with the flutes 26 of corrugator roll 20. The vacuum supplied by each vacuum finger 50 is thus communicated to the interior of its associated vacuum groove 30, with the open (in cross-section as shown at FIG. 4) portion of each groove 30 (not covered by a vacuum finger 50) being closed or covered by web 100 over the 180° of the latter's contact with roll 20. The outer edges of ends 62 of fingers 50 are close to web 100 at both nip regions 102 and 104, as shown at FIG. 2. While shown substantially spaced, for purposes of illustration only, the outer edge of fingers 62 of each vacuum finger 50 are spaced a distance of about 0.015 inches from the web 100, thus precluding substantial loss of vacuum between the web and the outer finger edges 62. This proximity inhibits entry of large amounts of ambient air from the two nip regions into the ends of the 180° arc of grooves 30 covered by web 100. Reference to FIGS. 2 and 4, particularly at FIG. 4, shows web 100 as closing the open edge of each groove 30. Any air between the web 100 and flutes 26, over the 180° zone of their mutual contact, will pass along the web-flute interface, in an axial direction along roll 20, and thence to one of the vacuum grooves 30 thereon. Hence, atmospheric pressure will hold the web 100 against the flutes. Clearly, if the angular extent of web-flute contact is varied, it is only necessary to correspondingly vary the angular extent between the ends 62 of fingers 50, to thereby maintain the supplementary relationship.

Quick disconnect coupling 70 is employed for the purpose of individually removing or repairing any vacuum finger 50. Any one of a number of commercially available couplings 70 may be employed.

The vacuum slots 30 move axially when the lower corrugating roll 20 expands and contracts in length due to changes in temperature during start-up. Temperatures change from room temperature of perhaps 50° F. to 375° F. when the roll 20 is fully heated by the steam in hollow interior 22. On some machines the lower corrugated roll 20 is adjusted laterally so that the grooves 30 do not contact the upper roll 12 and the pressure roll 40 always in the same place, and cause uneven wear.

The upper end of tube 72 is prevented from lateral movement by the stationary tube 76, but tube 72 is free to rotate in its center within "O" ring 90. The vacuum fingers 50 are free to rotate on the center of the couplings 70 and also on the 4 inch radius arc of the offset 73 in tube 72. Therefore, when the vacuum grooves 30 move axially, the vacuum fingers 50 are free to move with them. The maximum axial movement of the slots due to expansion and adjustment is less than $\pm\frac{1}{4}$ inch. It can be shown that with the 4 inch radius offset 73 that the movement of the vacuum fingers 50 away from pressure roll 40, and toward upper corrugator roll 12 will be less than 0.008 inches for the maximum movement in commonly employed steam temperatures on single facer machines of the type illustrated.

It is claimed:

1. A single facer machine for forming a corrugated paperboard laminate, the paperboard laminate defined by a corrugated paperboard layer adhesively secured to a flat paperboard layer, the machine including a first corrugating roll, a second corrugating roll, a glue applicator, and a pressure roll, the machine adapted to receive a first paperboard web for passage through the nip of the contiguous first and second corrugated rolls, the first paperboard web being corrugated at the nip of said first and second corrugating rolls, the glue applicator applying adhesive to the outwardly facing valleys of the corrugated first web, the machine further adapted to receive a second paperboard web passing over a part of the circumference of the pressure roll, the second paperboard web being adhered to the adhesively treated valleys of the first web at the nip between the second corrugating roll and the pressure roll to thereby form a two-layer paperboard laminate, means for applying and maintaining a vacuum to the flutes of the second corrugating roll over that part of the circumference of the second corrugating roll which is contacted by the corrugated first web to thereby maintain the corrugated first web in contact with the flutes of the second corrugating roll until the corrugated first web is adhered to the second paperboard web, the improvement comprising, the means for supplying a vacuum to the flutes of the second corrugating web including, (a) a plurality of axially spaced, circumferential vacuum grooves in the second corrugating roll, the grooves extending radially inwardly of the valleys between the flutes in said second corrugating roll, (b) a plurality of vacuum fingers, each finger aligned with and fitting into a respective one of said second corrugating roll grooves, each finger extending into its respective groove over an angular extent which is supplementary to the angular extent of the contact of the first paperboard web with the second corrugating roll, each vacuum finger extending into its respective groove to an extent radially inwardly of the valleys of the flutes of the second corrugating roll, (c) whereby the space between the corrugated first web and the flutes of the second corrugating roll is maintained at below atmospheric pressure, over a region defined by (1) the angular extent of circumferential contact of the first web and the second corrugating roll, and (2) between the axially spaced grooves of the second corrugating roll, (d) means for supplying a vacuum to each of said vacuum fingers, (e) a rigid tube connecting the source of vacuum to, respectively, each vacuum finger by a connection therewith at one end of the rigid tube, the rigid tube sealingly passed through, adjacent its other end, a wall of a vacuum supply duct, that portion of the rigid tube within the vacuum supply duct having an aperture in its walls, the rigid tube being adjustably secured to the vacuum duct so that the rigid tube is adjustably movable along its longitudinal axis, to thereby adjust its associated vacuum finger relative to its associated groove in the second corrugating roll.

2. The single facer machine of claim 1 wherein the connection of each rigid tube with its associated vacuum finger is a quick disconnect coupling, whereby the vacuum fingers may be easily removed for cleaning and repair.

3. The single facer machine of claim 1 wherein the rigid tube has an offset intermediate its ends and is also rotatable in the vacuum supply duct so that it can automatically compensate for longitudinal movement of the vacuum groove due to thermal expansion, or longitudinal adjustment of the corrugating roll.

4. The single facer machine of claim 1 wherein each rigid tube connects the source of vacuum to, respectively, each vacuum finger, one end of the tube carrying a quick disconnect coupling for coupling each tube to its respective vacuum finger.

* * * * *